US005291690A

United States Patent [19]

Pike

[11] Patent Number: 5,291,690

[45] Date of Patent: Mar. 8, 1994

[54] NIPPER CLAMP FOR PRECISON CLAMP SCISSORS SHARPENING SYSTEM

[76] Inventor: Arthur Pike, 66 Crystal Rock Ct., Middle Island, N.Y. 11953

[21] Appl. No.: 964,655

[22] Filed: Oct. 21, 1992

Related U.S. Application Data

[63] Continuation-in-part of Ser. No. 653,008, Feb. 8, 1991, Pat. No. 5,157,870, and a continuation-in-part of Ser. No. 890,963, May 29, 1992, abandoned.

[51] Int. Cl.[5] ..... B24B 3/52; B24B 3/60

[52] U.S. Cl. ..... 51/122; 51/218 R; 51/221 BS; 51/224; 51/231; 269/45; 269/262

[58] Field of Search ..... 51/121, 122, 125, 125.5, 51/216 A, 216 R, 216 ND, 216 H, 217 R, 217 A, 217 S, 218 R, 218 A, 221 BS, 224, 230, 231, 233, 234, 285, 220, 221 R, 98.5, 109 BS; 269/45, 262

[56] References Cited

U.S. PATENT DOCUMENTS

| | | | |
|---|---|---|---|
| 526,571 | 9/1984 | Gosling | 51/220 |
| 2,578,309 | 12/1951 | Kroczek | 51/125 |
| 2,762,175 | 9/1956 | Kramer | 51/285 |
| 2,797,534 | 7/1957 | Rouse | 51/122 |
| 2,829,473 | 4/1958 | Pruner | 51/219 |
| 3,818,641 | 6/1974 | Long | 51/125.5 |
| 3,863,395 | 2/1975 | Brown | 51/121 |
| 3,889,425 | 6/1975 | Miyamoto | 51/109 BS |
| 4,504,283 | 3/1985 | Charvat | 51/298 |
| 4,748,775 | 6/1988 | Imahashi | 51/229 |

*Primary Examiner*—Jack Lavinder
*Attorney, Agent, or Firm*—Alfred M. Walker

[57] ABSTRACT

A precision clamp blade sharpening system includes a fittably adjustable clamping device attached by means of a support bar to a spring-loaded pin level and an adjustable bar to a sliding bar on top of a housing unit wherein is situated a means for regulating the velocity of the rotation of a circular sharpening disc which performs the function of sharpening scissor and/or other blade edges held in the clamp device by means of adjustable pieces which set the blade edge at a degree setting desired by the user and which clamp device may be extended for use with large circular sharpening discs or replaced with one designed for the sharpening of cuticle nippers and/or the inside parts of other blades.

9 Claims, 7 Drawing Sheets

NIPPER CLAMP FOR PRECISON CLAMP SCISSORS SHARPENING SYSTEM

This application is a continuation-in-part of application Ser. No. 07/653,008, filed Feb. 8, 1991, now U.S. Pat. No. 5,157,870, and application Ser. No. 07,890,963 filed May 29, 1992 now abandoned.

This application is also based upon a Disclosure Document entitled "Nipper Clamp", filed Aug. 7, 1992.

BACKGROUND OF THE INVENTION

The present invention relates to a precision clamp blade sharpening system. It is designed to provide a sophisticated means of sharpening the edges of scissor blades, manicure nipper blades and dental curette instruments by means of a clamping device which is fittably adjusted onto the surface of a circular sharpening disc mounted on a unit, which regulates the velocity of its rotation for purposes of sharpening said scissor edge.

Devices which relate to the sharpening of knives, scissors and other cutting instruments are generally known in the art. However, none of the existing art provides a means for the exclusive sharpening of scissors by means of a rotational system with a fittably adjustable clamp.

SUMMARY OF THE INVENTION

Accordingly, it is an object of the present invention to provide a precision clamp blade sharpening system by the use of an adjustable clamping device which holds a blade, such as a scissor edge, of any length or width to be sharpened on the surface of circular sharpening disc. The sharpening disc lies atop the body of a unit wherein is contained a method of varying the velocity of the rotation of the circular sharpening disc.

Furthermore, it is an object of the present invention to provide an adjustable support bar which extends slidably outward from the top of the unit to facilitate variations in the setting of the clamp device, which clamp device holds the blade in place against the surface of the circular sharpening disc. The adjustable support bar also accomplishes the purpose of providing for the level and stable situation of the clamp device when in use.

More particularly, it is an object of the present invention to provide a precision clamp blade sharpening system by means of a sophisticated interlocking of movable and adjustable pieces, which permits the easy, expeditious and accurate sharpening of a blade, such as a scissor edge, to exact user specifications for a given task of sharpening. This is accomplished by mounting a circular sharpening disc atop a geometrically shaped housing unit in which is contained the means by which the circular sharpening disc is rotated to effect the sharpening of a scissor edge. The accessory assembly for the clamp device includes a measuring level, a support bar, a pin, lever and support bar spring, which pin lever and support string are attached to an adjustable vertical support bar, which vertical support bar fits into a horizontal slide bar on top of housing unit for the sharpening disc.

Another object of the present invention is to permit the level, stable and scientific sharpening of a blade edge by the use of a spring-loaded pin, which protects the user from unintentional contact with the scissor edge. The spring-loaded pin is situated in such a manner in and around the clamp device that the process of sharpening a scissor or other blade edge is contingent upon manual pressure being applied by the user upon the clamp assembly, User release of the aforementioned manual pressure automatically lifts the clamp holding the scissor blade away from the surface of the circular sharpening disc and away from the user.

It is a further object to provide a clamp for a manicure nipper blade which clamp orients the manicure nipper blade in any desired position for sharpening.

In keeping with these objects and with others which will become apparent hereinafter, one feature of the present invention resides, briefly stated, in a precision clamp blade sharpening device which includes a housing unit upon which is situated a disposable, rotating circular sharpening disc controlled by a preferably counterclockwise button on the exterior of said housing unit. A blade, such as a manicure nipper blade or a scissor edge, is placed into a clamp device, which clamp device preferably includes a clamp assembly of nuts, support bars, a level, a spring-loaded pin, a lever, and an adjustable support bar, which clamp assembly fits into the top of a horizontal slide bar located on the top of the housing unit near one end of the circular sharpening disc.

For a manicure nipper blade wherein the blade edge may be curved, there is provided an alternate clamp which securely holds a nipper in both an open and closed position, to accommodate the sharpening of the curved edges and flat surfaces of the blades.

In the preferred embodiment, the clamp is rotatable from 0 degrees to 90 degrees in a first plane perpendicular to the axis of the support bar holding the clamp, as well as being rotatable from 0 degrees to 90 degrees in a second plane perpendicular to the first plane.

The novel features which are considered as characteristic for the invention are set forth in particular in the appended claims. The invention itself, however, both as to its construction and its method of operation, together with additional objects and advantages thereof, will be best understood from the following description of its specific embodiment when read in connection with the accompanying drawings.

DESCRIPTION OF PREFERRED EMBODIMENTS

Figure 1:
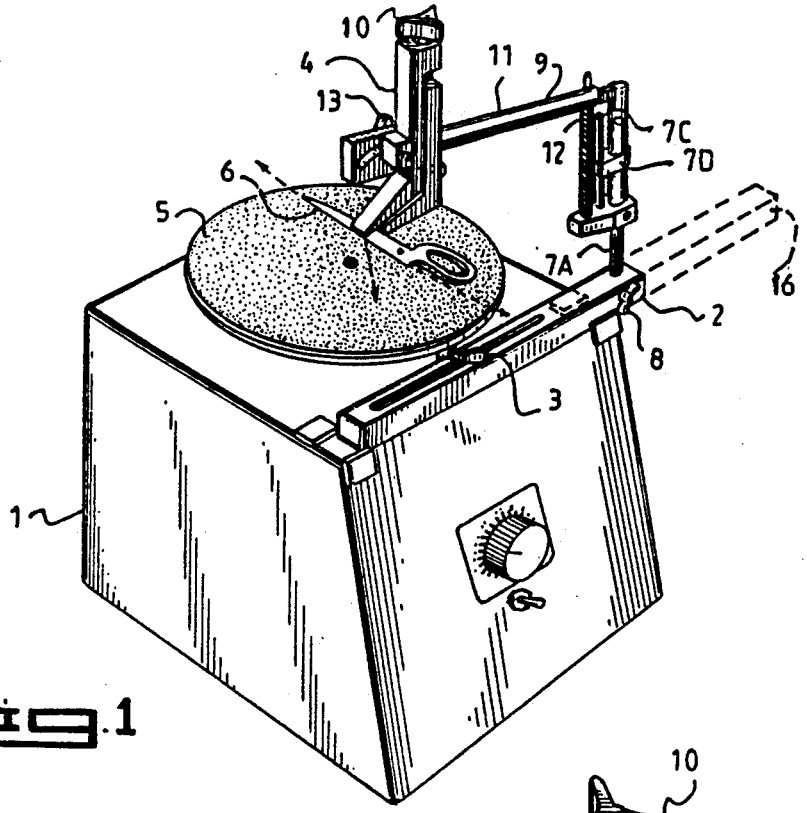
FIG. 1 is a perspective view of one embodiment of the precision clamp blade sharpening device.

As shown in FIGS. 1,2,3,5,6 and 7, an embodiment for a precision clamp blade sharpening system for scissors has a housing unit 1 upon which is located slide bar 2 and wing nut 3, which control the operation of the system. The scissors 6 to be sharpened is held within clamp 4. Clamp 4 has upper and lower jaw pieces having blade engaging surfaces parallel to each other.

As further shown in FIGS. 1, 2, 3, 5, 6, and 7, the proper aligning position for clamp 4 is a holding mechanism including horizontal support bar 9 for clamp 4, the holding mechanism includes a vertical adjustable unit, including a first lower vertical bar 7A, slidable within a hollow conduit within hollow upper vertical extension member 7B, horizontal base slide bar 2, within which vertical adjustable support bar 7 is also vertically slidable, spring loaded pin lever 12 between support bar 9 and hollow upper vertical extension member 7B, which vertical extension member 7B is joinable to lower vertical bar 7A.

When slide bar 2 is extended in an outward position, a scissor edge is placed into clamp 4 the clamp 4 can be set a degree setting of between zero degrees and sixty-five degrees for purpose of the scissors edge being sharpened by the rotation of circular sharpening disc 5 (most scissors range in settings from twenty-five to thirty degrees for maximal use of the sharpening disc 5). Once scissor edge 6 is placed at the desired setting, vertical adjustable bar 7A, which is vertically adjustable within slide bar 2 at the lower end of adjustable bar 7A, is adjusted by wing nut 8 to assure that the clamp holding bar 9 is level straight across, to assure a true edge for the scissor edge blade undergoing the sharpening process when the scissors blade within clamp 4 is in contact with the surface of the circular disc 5 at the setting of zero degrees. This assures that the degree setting selected for the clamp 4 is the same one that will be found for the sharpening of scissor edge 6 as said scissor edge is "trued" from the circular disc 5. Scissor edge 6 is locked into clamp 4 by means of a handle 10.

In a preferred embodiment, the sharpening disc 5 includes a magnetic support plate beneath a separate removable metal sharpening disc.

Measuring level 11 is attached to clamp holding bar 9 to indicate to users that the setting is true and accurate to that which has been selected and that a level surface setting is locked in place. The spring-loaded pin lever 12, including pin 12A and spring 12B is attached to the rotatable clamp 7E about vertical bar 7B to regulate the pressure which is applied manually onto the clamp 4, during the process of sharpening a blade, such as scissor edge 6. The spring-loaded pin lever 12 also secures the safety of the user as the release of pressure upon clamp 4 automatically releases scissor edge 6 from circular sharpening disc 5 in a manner which does not threaten the user.

Whether a scissors' blade or a manicure nipper blade is being sharpened, it is desirable to provide a clamp which can rotate to a desired orientation of the blade 6 upon sharpening disc 5. In one embodiment shown in FIGS. 1,2,3,5,6 and 7, clamp 4 is movable arcuately in a predetermined arc.

Figure 2:
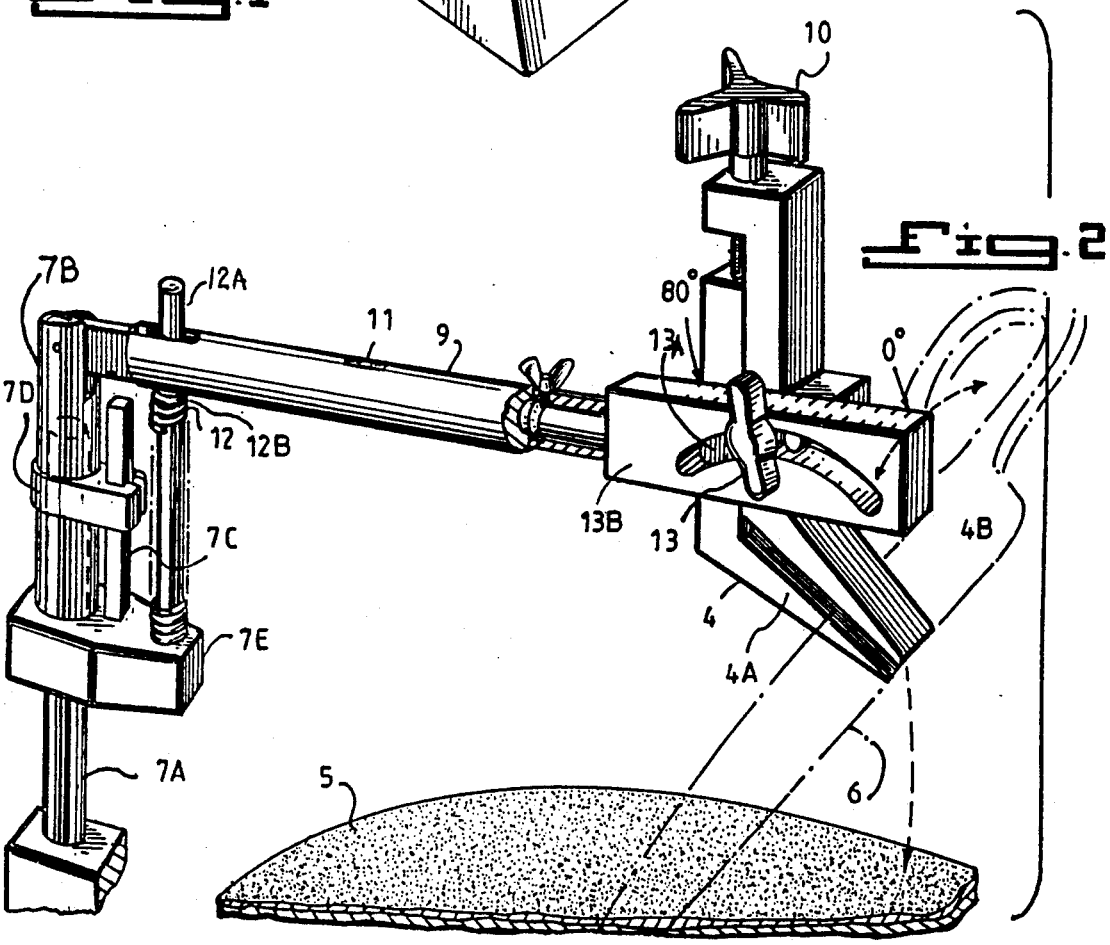
FIG. 2 is a close-up view of clamping assembly and its attachments as shown in FIG. 1.
Figure 7:
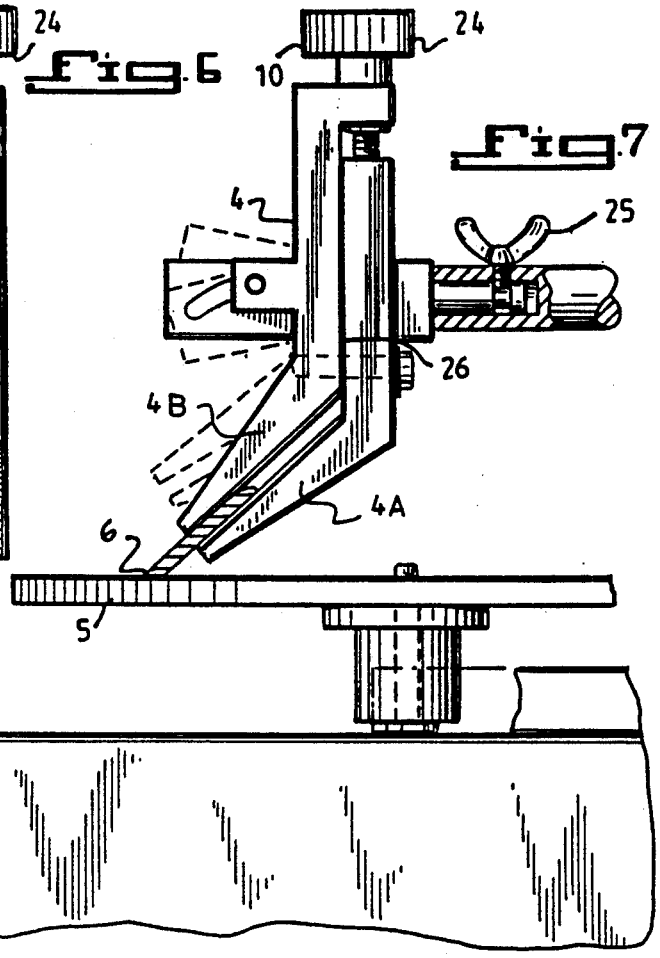
FIG. 7 is a close-up side elevation view of the clamping assembly portion of the device as shown in FIG. 1.

The secondary wing nut 13 holds the clamp 4 in place at a stationary ninety degrees, which gives the control of maintaining a zero degree surface from the top to the bottom of the scissors' blade. As also shown in FIGS. 2 and 7, the wing nut 13 can be adjusted to the desires of the user to rotate the clamp 4 off of a vertical alignment, so that jaws 4A and 4B of clamp 4 rotate from zero to eighty degrees off of a vertical alignment.

The clamp device 4, support bar 9 and adjustable support bar 7, can be adjusted by the extension of the slide bar 2 for the comfort of users who are left-handed.

The vertical axis of clamp 4 generally is set at ninety degrees to the surface of sharpening disc 5 while the claw part, namely claws 4A and 4B are set at forty-five degrees.

The entire surface of blade 6 is applied to the surface of the sharpening disc 5, thereby allowing for an even sharpening of the entire blade, as opposed to sharpening incrementally against the limited circumferential edge surface of conventional upright discs.

As shown in FIG. 1, the machine of the present invention is shown with circular disc 5. Clamp device 4 is situated above circular disc 5 with the slide bar 2 in a closed position in solid coloration, and in an open position by use of broken lines 16 for the adjustment of clamp device 4 according to user specifications and desires. Wing nut 3 in the center of slide bar 2 controls the length of said slide bar for the positioning of clamp device 4.

As shown in FIG. 2 and 7, the loosening and tightening of nut 13 within arcuate opening 13A of clamp holding member 13B permits the variable rotatable adjustments of clamp device 4 for sharpening assignments that do not use the settings mentioned above.

As shown in FIG. 2, there is shown the opposite side of clamp 4 and the method by which wing nut 13 permits the setting of the desired degree of sharpening within the parameters which limit the movement of jaw parts 4A and 4B of clamp 4 from zero to eighty degrees in a plane parallel to the longitudinal axis of support bar 9. This facilitates adjustments for scissors of different lengths and widths.

Clamp 4 is locked at a consistent ninety degrees vertical by the use of the clockwise motion of adjustable nut 13 within arcuate opening 13A of clamp holding member 13B to facilitate the stabilization of the degree setting selected by the positioning of wing nut 13. Also shown is level determining means 11, such as a bubble level measurer in the center of support bar 9, which itself is connected to spring-loaded pin lever 12.

As further shown in FIG. 2, an optional zero gravity vertical stop lock bar 7C, swivelable about upper hollow vertical extension lever 7B by means of rotatable clamp 7D, may be provided to prevent horizontal support bar 9 from deviating downward off of the desired horizontal alignment.

It, however, does not prevent manual upward adjustment of support bar 9. If, however, one desires to lower the scissors blade 6 within the clamp 4 to take off larger amounts of metal (rather than close sharpening of blade 6), then vertical stop lock bar 7C can be swiveled 180 degrees by means of rotatable clamp 7D which clamp is rotatable over upper hollow extension member 7B to remove the stop lock bar 7C away from underneath support bar 9.

Figure 3:
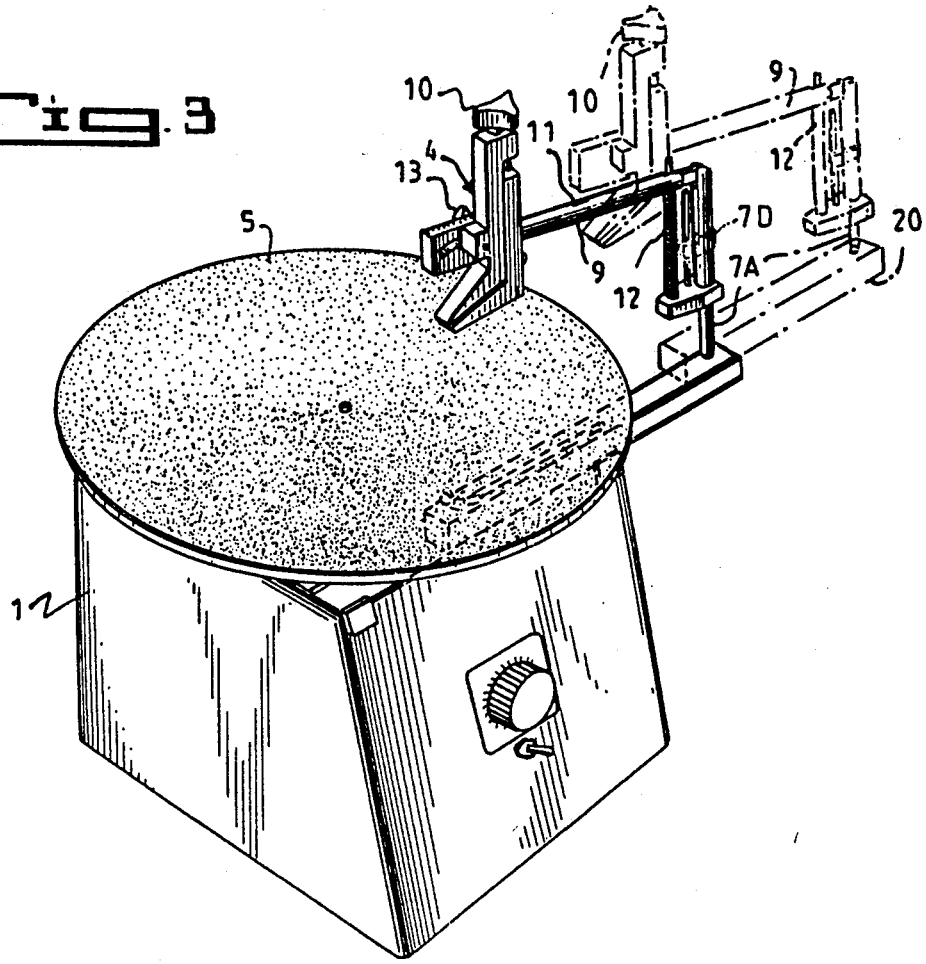
FIG. 3 is a perspective view of the device shown in FIG. 1 in two different settings by means of the adjustable slide bar.

As shown in FIG. 3, there is shown the clamp device 4 in a position of total extension in dotted lines, by means of a "piggy-back" further extension bar 20 which may be added for purposes of a longer extension with a larger sharpening disc or with a longer blade of scissors for sharpening of same.

The disposable, circular sharpening disc 5 may generally range in diameter from five to twelve inches; the addition of extension bar 20 affords a user the option of a sharpening disc twelve inches in diameter or larger.

Figure 4:
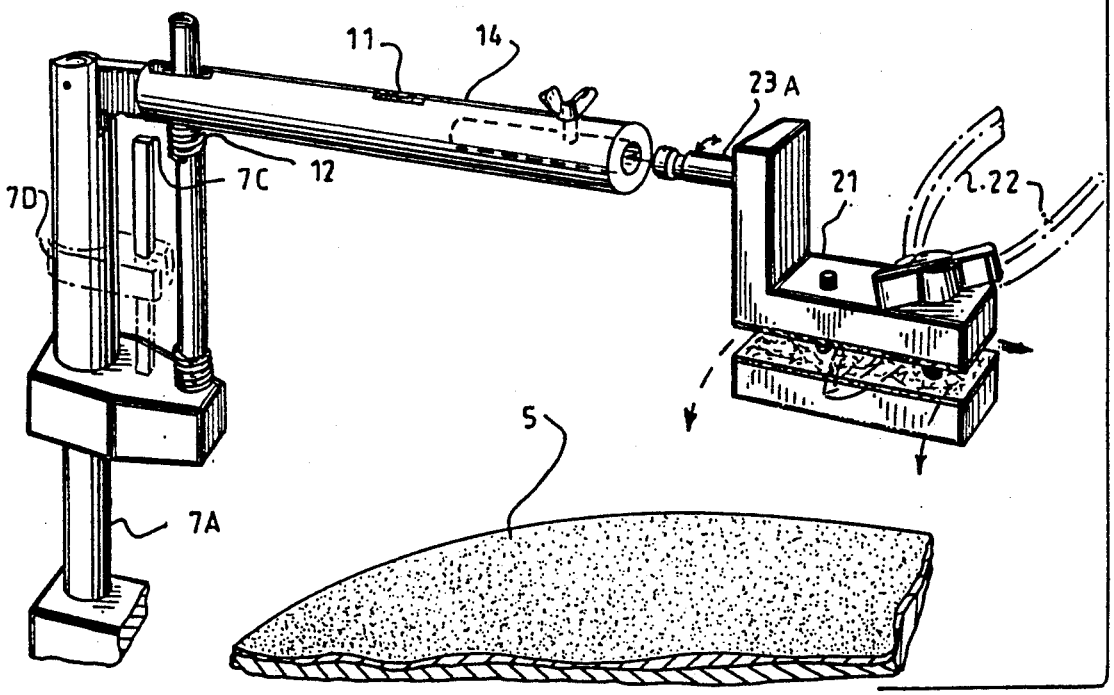
FIG. 4 is a close-up view of the device with an alternate clamp assembly for cuticle nippers.
Figure 9:
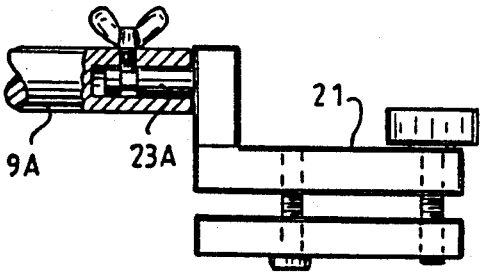
FIG. 9 is a front elevation view of the cuticle nipper sharpening embodiment of the device as shown in FIG. 4.
Figure 10:
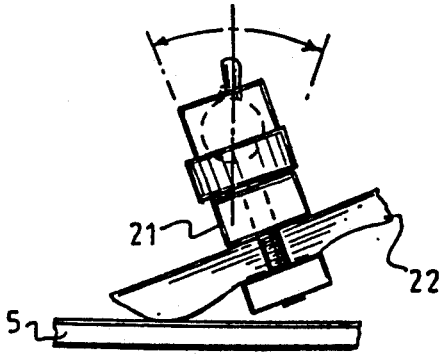
FIG. 10 is a side elevational view of the cuticle nipper sharpening embodiment of the device as shown in FIG. 4, showing its ability to tilt up or down according to user needs.
Figure 11:
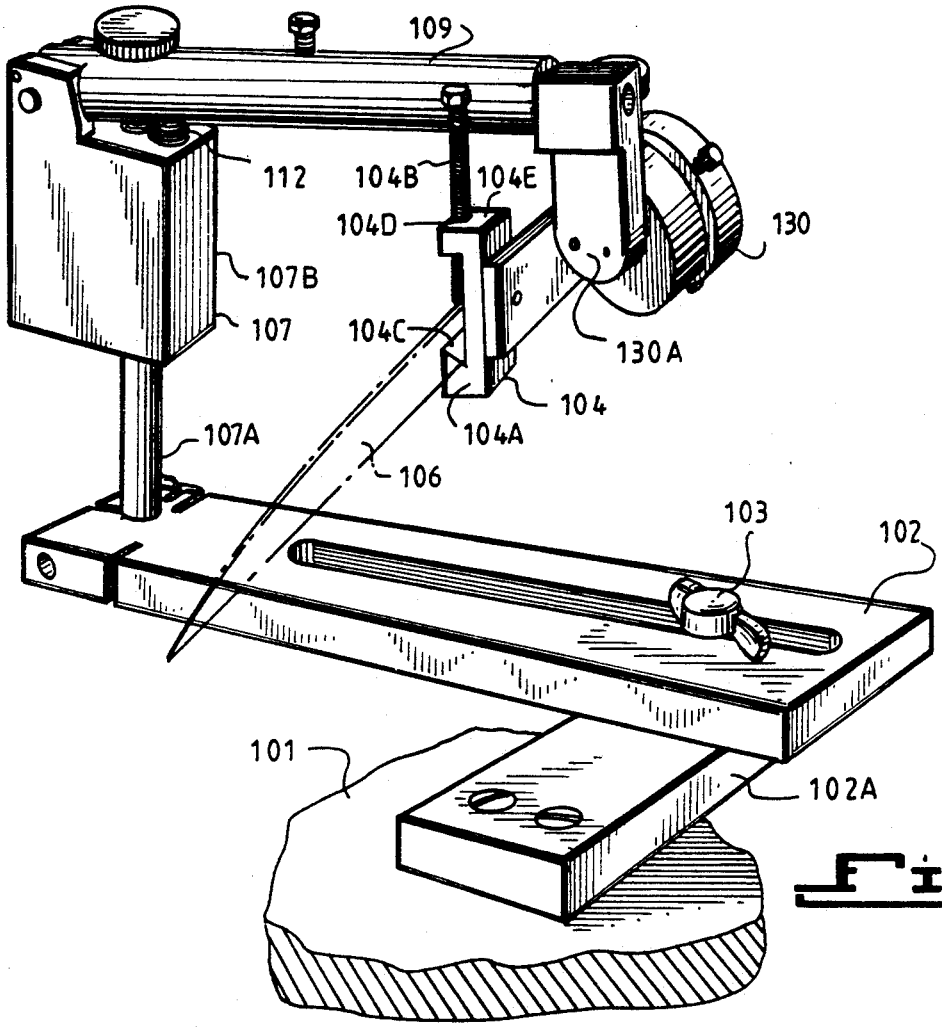
FIG. 11 is a perspective view of an alternate embodiment for scissors sharpening.
Figure 12:
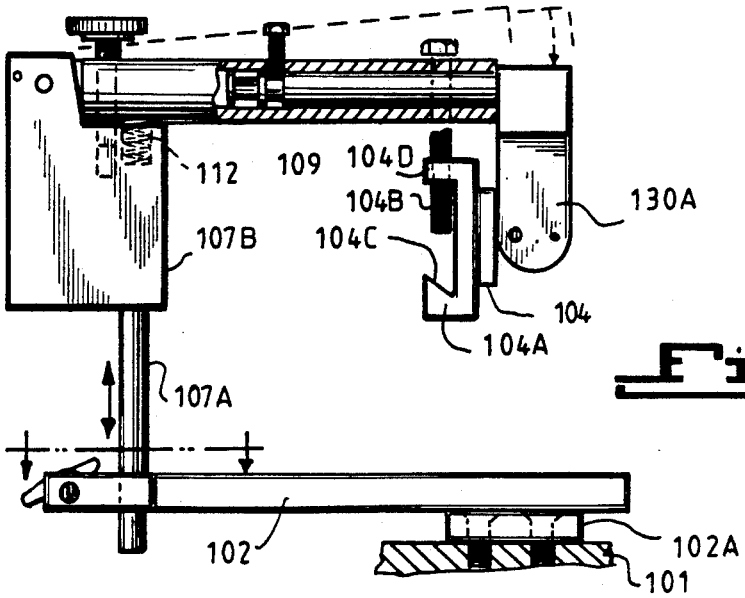
FIG. 12 is an end view of the embodiment shown in FIG. 11.

In an alternate embodiment for a manicure nipper, as seen in FIGS. 4,9 and 10, horizontal support bar 14 is shown with an alternate clamp device 21 designed for purposes of sharpening the inside rise of a scissor blade as well as to be used for the sharpening of an instrument known as a cuticle nipper 22, shown here in dotted lines as it would be placed into the clamp device 21. This permits the flat surfacing of the instrument edge upon circular sharpening disc 5 for the purpose of the desired sharpening.

Swivel bar 23A permits clamp device 21 to be rotatably moved from side to side about an axis perpendicular to the longitudinal axis of support bar 14. Swivel bar 23A also permits clamp device 21 to be locked in a particular position at the discretion of the user, and also facilitates the removal of the clamp device 21 at an angle upwards of one hundred eighty degrees away from the surface of circular disc 5, to permit the removal and replacement of the circular disc.

Figure 5:
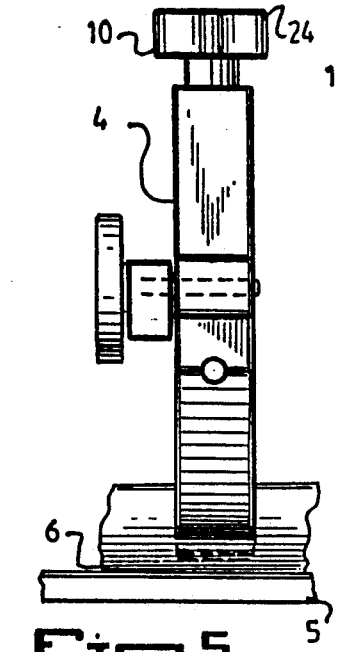
FIG. 5 is a front elevation view of the clamp assembly portion of the device as shown in FIG. 1.

As shown in FIG. 5, in the embodiment also shown in FIGS. 1,2,3,6 and 7, the front part of clamp device 4 holding a blade, such as scissors blade 6, is shown with respect to its perpendicular orientation to the surface of circular disc 5.

Figure 6:
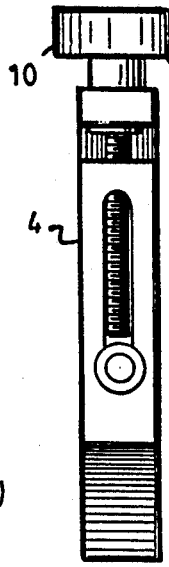
FIG. 6 is a close-up rear elevation view of the clamp assembly portion of the device as shown in FIG. 1.

As shown in FIG. 6, the back part of clamp device 4 is shown with rotatable handle 10 which allows clamp assembly 4 to slide up and down and to operate as a vise system for the sharpening of scissor edges on the surface of circular disc 5.

As shown in FIG. 7, a side-view of the clamp device 4 depicts how clamp device 4 is placed in various settings and can be moved from side to side to facilitate the demands of user specifications.

As also shown in FIG. 7, in general, locking piece 25 keeps clamp device 4 stationary in relation to circular disc 5, while the seam 26 of clamp device 4 is set at ninety degrees, and jaws 4A and 4B of clamp 4 hold scissor edge 6 at a forty-five degree angle to maximize the sharpening of said scissor edge.

As shown in FIG. 2, the possible arcs of setting the clamp 4 in place by wing nut 13, are from zero degrees within arcuate opening 13A of clamp holding member 13B, to eighty degrees, to facilitate the desired setting of the blade, such as scissor edge 6, in clamp 4 at a desirable angle to circular sharpening disc 5.

Figure 8:
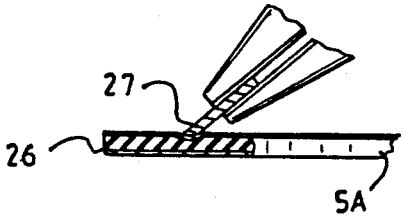
FIG. 8 is a close-up cut-away view of the device with an alternate sharpening disc specifically to receive a convex-edge blade.

As shown in a further embodiment described in FIG. 8, there is shown another circular sharpening disc 5A, which is designed to sharpen convex edge blades. The disc, which has pliable support means 26 beneath the cutting surface, fits on the surface of the housing unit and accepts the convex edge blade 27. Disc 5A takes the shape of the convex edge blade 27 as the sharpening surface 5A above pliable support means 28 is indented responsive according to the surface of the convex edge blade 27. No other existing system has such a method of sharpening convex edge blades without a computerized-guided methodology.

As shown in FIG. 4, 9 and 10, an alternate nipper clamp assembly 21 is shown in its position with the desired effect being an ability to serve as a vise for the sharpening of blades, such as blade 22. The clamp 21 may be moved adjustably either left or right depending upon the angle of the nipper blade 22 being sharpened. The nipper clamp device 21 has rotatable and swivelable clamp internal support member 23A, rotatable within support bar 14 for rotating the alternate clamp assembly 21 left or right off of a vertical axis to accomplish tipping of the nipper blade 22.

As shown in FIG. 10, the alternate cuticle nipper clamping assembly 21 is shown with its ability to tip up or down depending upon user demands in the arcuate directions shown by the directional arrows.

As a method of operation for the device shown in FIGS. 1, 2, 3, 6 and 7, generally the blade, such as scissors blade 6, is positioned within clamp 4. The appropriate sharpening angle for the scissors blade 6 with respect to the horizontal rotating sharpening disc 5 disc is measured and determined with respect to the horizontal surface of disc 5 and an imaginary vertical axis of clamp 4. The scissors blade 6 is then biased by downward force against countervailing force from a spring lever 12 against the rotating surface of disc 5 until the appropriate sharpening is accomplished.

When a cuticle scissors blade 22 with a convex curvature 27 of the blade 22 in profile is used as shown in FIG. 8, a movable clamp 21 holds the blade 22 while downward force is applied against the disc 5A, and pliable support means 26 beneath the disc 5A, such that disc 5A and pliable support means 26 indent responsive to the curvature of convex blade 22, until the appropriate sharpening is accomplished.

As shown in a further alternate embodiment as shown in FIGS. 11-16, a precision blade sharpening system has a housing unit 101, upon which is located extension support member 102A, upon which horizontal slide bar 102 is rotatable to a desired position, at which position slide bar 102 is fastened in place by wing nut 103. The scissors blade 106 to be sharpened is held and grasped within clamp 104 by clamp members 104A and 104B. Clamp member 104A is preferably a fixed U-shaped lock having a beveled surface 104C upon which scissor blade 106 rests. Clamp member 104B is preferably a movable joint member, such as a threaded bolt threadable within threaded hole 104D of top cantilevered portion 104E of clamp 104.

The proper aligning position for clamp 104 is maintained by a holding mechanism, including horizontal support bar 109 for clamp 104, vertical member 107, including lower member 107A slidable within a conduit within upper vertical member 107B, horizontal base slide bar 102, within which vertical adjustable support member 107A is also vertically slidable, and spring loaded pin lever 112 between support bar 109 and vertical member 107B.

When slide bar 102 is extended in an outward position, a scissor edge is placed into clamp 104, which clamp 104 can be set a degree setting of between zero degrees and eighty degrees by means of clamp limiting member 130, for purposes of the scissor's blade 106 being sharpened, by the rotation of circular disc 5.

It is noted that most scissors range in settings from twenty-five to thirty degrees for maximal use of the sharpening disc 5. However, the device of the present invention provides a range of generally from zero to eighty degrees for a scissors blade.

Figure 13:
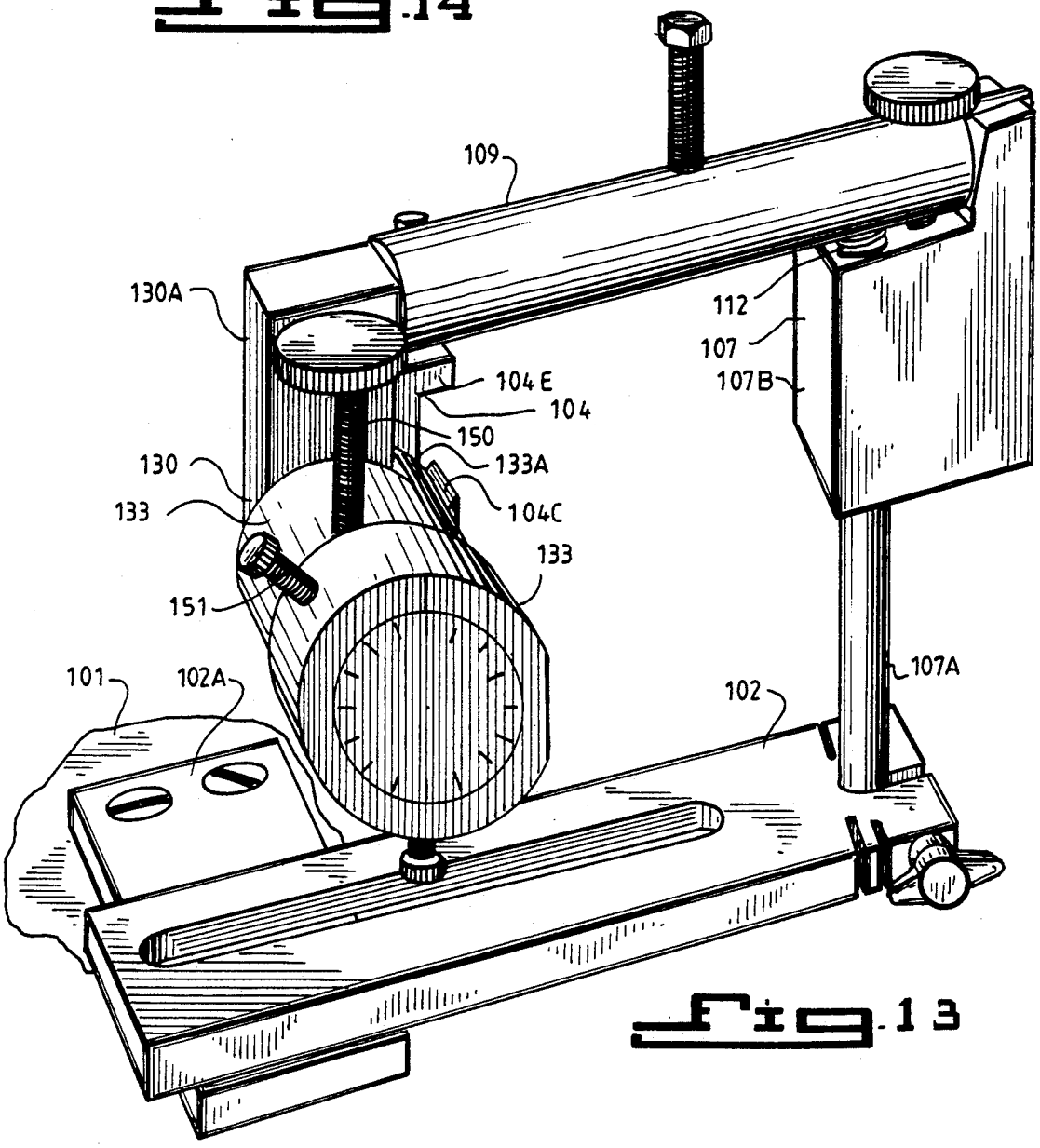
FIG. 13 is a close up perspective view of the clamp portion of alternate embodiment.
Figure 15:
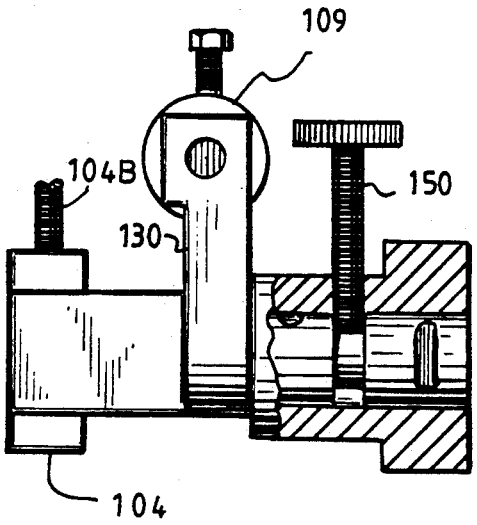
FIG. 15 is a close up front view of part of the alternate embodiment in partial section.
Figure 16:
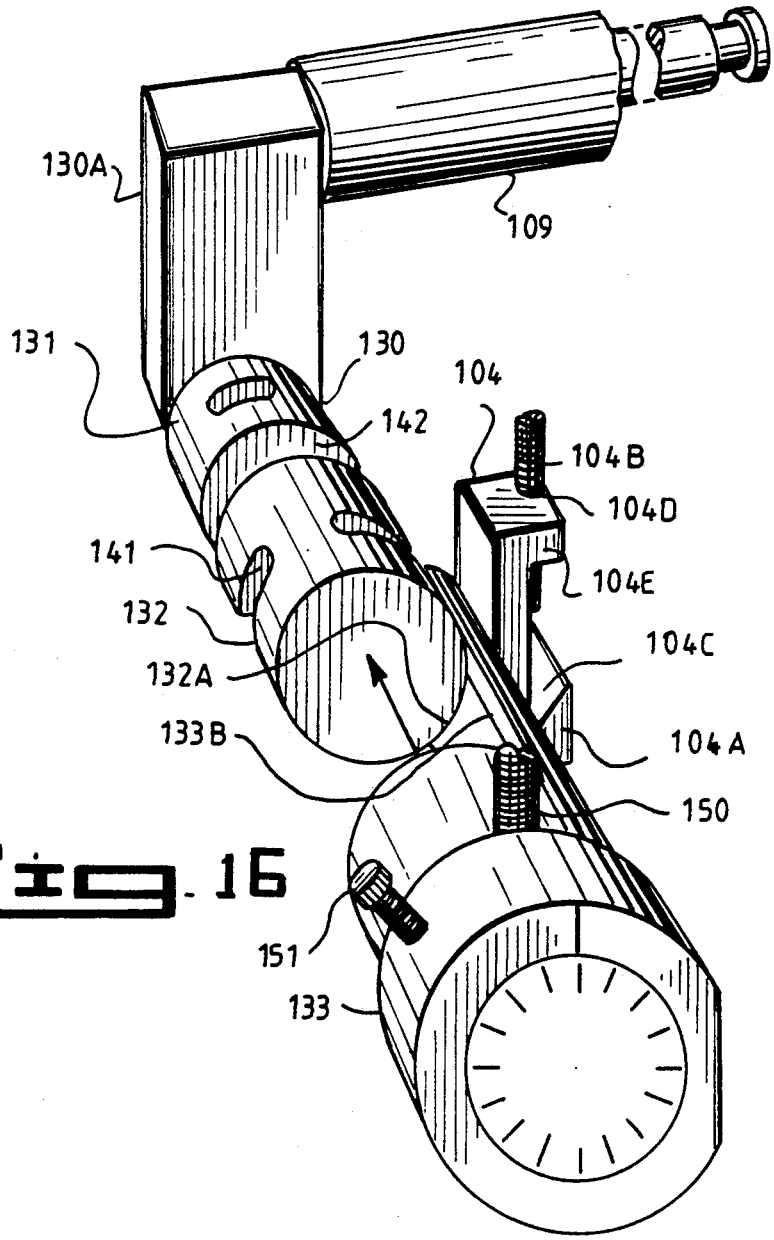
FIG. 16 is a close up perspective view of the clamp holding portion of the alternate embodiment.

As shown in FIGS. 13, 15 and 16, clamp limiting member 130 is attached to support bar 109 by extension arm 130A. Moreover, clamp limiting member 130 includes cylindrical member 132, which extension member 132 has indented arcuate slots 141 and 142 indented within its preferably cylindrical mass. Limiting screws not shown) limit the movement of the clamp to the desired arc dictated by arcuate slots 141 and 142, to assure that the scissors blade 106 within clamp 104 is in contact with the surface of the circular disc 5 at the desired setting.

Clamp 104 is extended from truncated further cylindrical member 133, which truncated cylindrical member 133 has an extended arm portion 133A with a concave surface 133B reciprocally slidable about reciprocal convex surface 132A of cylindrical member 132. Therefore, truncated further cylindrical member 133 is movable about the surface of cylindrical member 132 in the desired arc limited by arcuate slots 141 and 142, within which limiting screws (not shown) travel to move clamp 104 to a desired setting.

However, when one desires to move a blade surface of disc 5, then limiting screws (not shown) can be loosened so that the convex scissors edge may be rotated to the desired arc as defined by arcuate slots 141 and 142. Further fastening screws 150 and 151 tighten clamp limiting members 132 and 133 in place.

Figure 14:
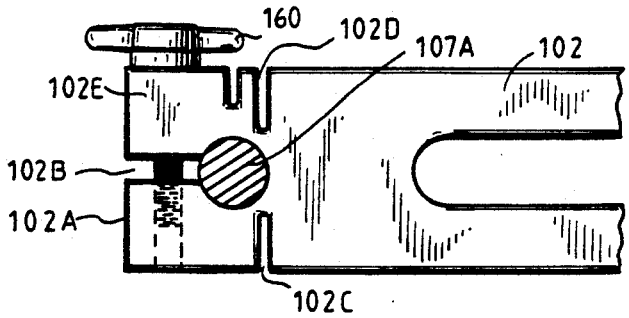
FIG. 14 is a close up top plan view of part of alternate embodiment.

As shown in FIG. 14, to facilitate the tight holding of vertical member 107A within horizontal slide bar 102, vertical member 107A may be locked in place within horizontal bar 102 by fastening means 160. Horizontal bar 102 contains at one end 102A a slot 102B parallel to the longitudinal axis of horizontal bar 102, in conjunction with slots 102C and 102D extending perpendicular to the longitudinal axis of horizontal bar 102, so as to create a "Y" shaped holding portion with two wing members 102E and 102F, which close toward each other by the tightening motion of fastening means 160, thereby squeezing vertical bar 107A tightly in place.

Figure 17:
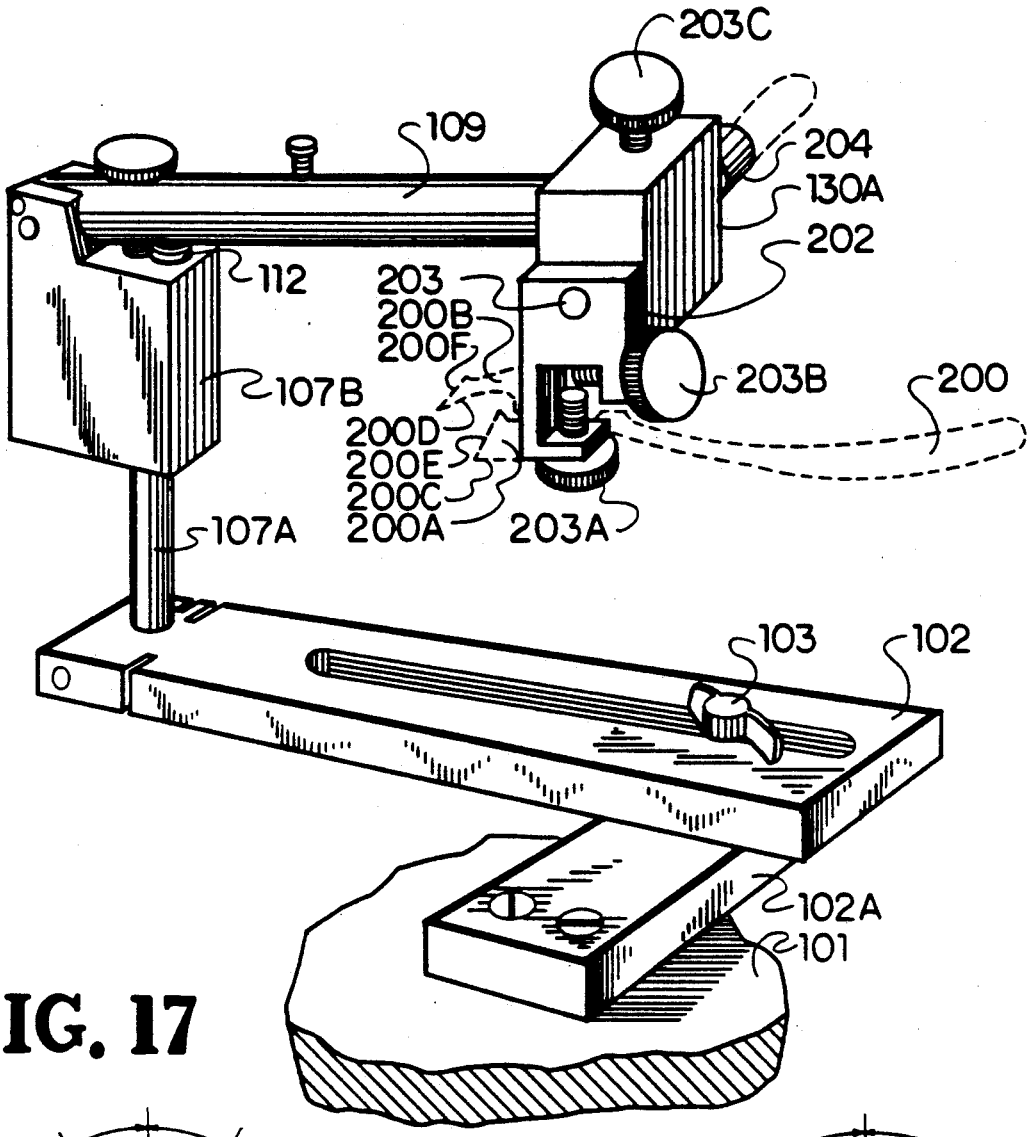
FIG. 17 is a close up perspective view of a further alternate embodiment for sharpening a manicure nipper.
Figure 18:
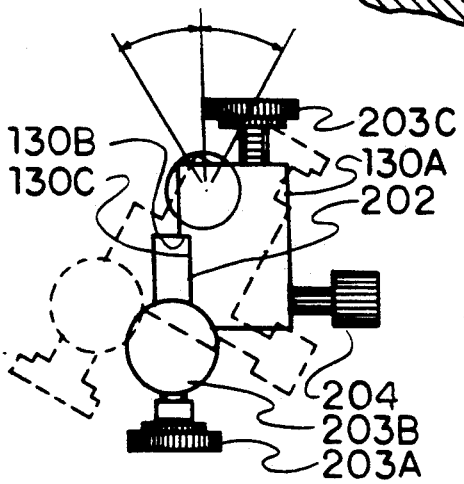
FIG. 18 is a close up front view of the embodiment shown in FIG. 1.
Figure 19:
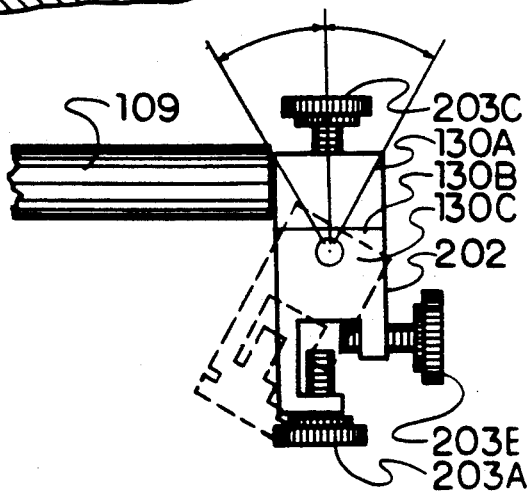
FIG. 19 a close up side view of the embodiment shown in FIG. 17.

As further shown in an alternate embodiment shown in FIGS. 17–19, a precision clamp sharpening system for a manicure nipper 200 has a housing unit 101, upon which is located extension support member 102A, upon which horizontal slide bar 102 is rotatable to a desired position, at which position slide bar 102 is fastened in place by wing nut 103.

Manicure nippers, such as nipper 200 may be of the "box nipper" type as shown in FIG. 17 wherein the two nipper blades are the same size, or may be an "overlap nipper", wherein one of the blades is larger, so it overlaps the smaller nipper blade. The manicure nipper 200, has inside nipper blade surfaces 200A and 200B, with each inside blade surface 200A and 200B respectively having outside blade edges 200C,200D, 200E and 200F respectively, to be sharpened, and nipper 200 is held and grasped within clamp 201 by movable clamp member 202 and locking holding members 203A and 203B, such as a locking screws, oriented perpendicular to each other to securely hold nipper 200 within clamp 202.

As shown in dotted lines on FIG. 17, the manicure nipper 200 is shown in an open position with the blades spread apart to enable the left or right insides of the surfaces 200A and 200B of the nipper blades be sharpened. When it is necessary to sharpen the outside top blade edges 200C and 200D respectively, when the nipper blades are closed together, the nipper 200 is held in such a closed position within clamp 202 by locking screws 203A and 203B.

As shown in FIG. 17, the extension member 130A is rotatable from 0 degrees to 360 degrees about horizontal support bar 109. While horizontal bar 109 can be held at a flat 0 degrees horizontal orientation, it can also be held by spring lever 112 at 15 approximately 15 degrees, in case an overlap nipper is used, thereby requiring a pitch of 0 degrees to 15 degrees of the support bar 109.

Moreover, clamp 202 and extension member 130A are rotatable from 0 degrees to 360 degrees about support bar 109, depending upon the tool to be sharpened, such as a manicure nipper, which requires 0 degrees to 15 degrees rotation of clamp 202, about support bar 109, or a dental curette blade, which, because of its exaggerated crescent shaped blade, requires the clamp 202 be rotatable from 0 degrees to 90 degrees about support bar 109.

Clamp 202 is preferably a fixed generally U-shaped member within which nipper 200 rests, held in place by locking screws 203A and 203B extending perpendicular to each other against nipper 200. Clamp member 202 is preferably a movable joint member, movable about rod 203, having rod handle 204, which rod 203 is threadable within top cantilevered extension member 130A. The proper aligning position for clamp 202 is maintained by a holding assembly for clamp 202, including horizontal support bar 109 for clamp 202, vertical member 107, including lower member 107A slidable within conduit within upper vertical member 107B, horizontal base slide bar 102, within which vertical adjustable support member 107A is also vertically slidable, and spring loaded pin lever 112 between support bar 109 and vertical member 107B. When slide bar 102 is extended in an outward position, a manicure nipper edge is placed into clamp 202, which clamp 202 can be set a degree setting of between zero degrees and ninety degrees by means of clamp limiting rod 203, for purposes of the nipper 200 being sharpened, by the rotation of circular disc 5. Most nippers range in settings from twenty-five to thirty degrees for maximal use of the sharpening disc 5. However, the device of the present invention as shown in FIGS. 17–19 provides a range of from zero to ninety degrees.

Moreover, clamp limiting rod 203 is rotationally movable within extension member 130A, by means of the rotational movement of handle 204.

FIG. 17 shows nipper 200 in the adjustable holding handle 202 in position for the cutting disc to sharpen the interior nipper blades surfaces 200A and 200B. FIG. 18 shows nipper clamp 202 and extension member 130A both movable together about support bar 109, when only the edges of 200C and 200D of the nipper 200 in a closed position are sharpened. As shown in dotted lines, clamp 202 can be pivoted up or down, forward or back at a 90 degree angle for sharpening the left or right side of the cutting face of the nipper 200.

FIG. 19 shows a further positional variation of nipper clamp 202 when sharpening the nipper 200 in an open position for sharpening the inside or outside edges 200E or 200F of manicure nipper 200 as well as inside surfaces 200A and 200B of nipper 200.

As noted in FIG. 19, the extension member 130A is shown not movable, while only the clamp 202 is movable about rod 203. This maneuver is accomplished by loosening third locking screw 203C, which loosens clamp 202 from extension member 130A from its resting position within the recess defined by horizontal recess wall 130B and vertical recesss wall 132C of extension member 130A. When moved forward from the recess, clamp 202 is free to move by itself about 203, and extension member 130A remains stationary.

While the illustrated embodiment herein has been set forth as aforesaid, it is understood that various versions may be made without departing from the scope of this invention, as noted in the appended claims.

I claim:

1. An improved clamp scissors blade sharpening device wherein the device includes:

a rotating sharpening disc having a planar sharpening surface, a clamp for a blade, the clamp movable toward the planar sharpening surface, a holding device for the clamp including a vertical support member supporting a movable horizontal support member, the movable horizontal support member supporting the clamp, the vertical support member supported by a horizontal slidable base support member, a spring loaded pin lever extending between the movable horizontal support member and the vertical support member, the lever using the horizontal support member away from the vertical support member, the horizontal support member pivotable about a pivot in the vertical support member, the vertical support member having a limit member to stop downward vertical movement of the horizontal support member with the clamp attached thereto, wherein said clamp comprises a U-shaped clamp.

2. The clamp as in claim 1 wherein said U-shaped clamp further comprises a beveled surface within said clamp, the blade resting upon said beveled surface within said clamp.

3. The clamp as in claim 1 wherein said U-shaped clamp further comprises a movable joint member.

4. The movable joint member as in claim 3 further comprising a threadable bolt member threadable within a hole within a cantilevered top portion of said U-shaped clamp.

5. The horizontal support member as in claim 1 wherein said horizontal support member is attached to a generally cylindrical clamp limiting member, said clamp limiting member having a plurality of indented arcuate slots indented within a surface of said cylindrical clamp limiting member, said U-shaped clamp attachable to an extended arm portion, said extending arm portion having an arcuate concave surface corresponding to an arcuate convex surface of said cylindrical clamp limiting member, said extending arm portion movable arcuately about said cylindrical clamp limiting member, said extending arm portion movable within said arcuate slots, said extending arm portion having limiting screws to limit the movement of said extension arm and said clamp.

6. The device as in claim 1, wherein said horizontal slidable base support member comprises a hole for insertion of said vertical support member, a first slot parallel to a longitudinal axis of said horizontal slidable base support member, said first slot extending outward from and contiguous to said hole, a plurality of further slots perpendicular to the longitudinal axis of said horizontal slidable base support member, said horizontal slidable base support member further comprising a pair of winged end portions, each winged end portion extending outward with said first slot extending therebetween, a fastening means engageable with said winged end portions for moving each of said winged end portions toward each other said winged end portion within said first slot for tightening said vertical support member within said hole adjacent said first slot.

7. The clamp as in claim 1 further comprising a U-shaped clamp member, said clamp member engageable with a pair of locking screws, each said locking screw movable in a perpendicular direction toward each other of said locking screws for retaining a nipper blade therebetween; said U-shaped clamp member rotatable about a rod member, said rod member rotatable within an extension member by means of a rod handle in a plane parallel to a longitudinal axis of said horizontal support member for said clamp member.

8. The clamp in claim 7 wherein said clamp rests within a recess within said extension member, said clamp movable forward from said recess of said extension member for free rotation of said clamp.

9. An improved clamp scissors blade sharpening device wherein the device includes:

a rotating sharpening disc having a planar sharpening surface, a clamp for a blade, the clamp movable toward the planar sharpening surface, a holding device for the clamp including a vertical support member supporting a movable horizontal support member, the movable horizontal support member supporting the clamp, the vertical support member supported by a horizontal slidable base support member, a spring loaded pin lever extending between the movable horizontal support member and the vertical support member, the lever urging the horizontal support member away from the vertical support member, the horizontal support member pivotable about a pivot in the vertical support member, the vertical support member having a limit member to stop downward vertical movement of the horizontal support bar with the clamp attached thereto, wherein said clamp comprises a pair of movable jaw pieces.

* * * * *